United States Patent [19]

Kohmura et al.

[11] Patent Number: 4,879,197

[45] Date of Patent: Nov. 7, 1989

[54] METHOD OF DEVELOPING ELECTRONIC PHOTOGRAPH WITH LIQUID DEVELOPER AND CLEANING EXCESS THEREOF

[75] Inventors: Isao Kohmura; Takao Senga; Akira Furukawa; Hirokazu Yamamoto; Mamoru Nakatani; Jun Yamada, all of Nagaokakyo, Japan

[73] Assignee: Mitsubishi Paper Mills, Ltd., Tokyo, Japan

[21] Appl. No.: 251,066

[22] Filed: Sep. 27, 1988

Related U.S. Application Data

[63] Continuation of Ser. No. 849,378, Apr. 8, 1986, abandoned.

[30] Foreign Application Priority Data

| | | | |
|---|---|---|---|
| Apr. 12, 1985 | [JP] | Japan | 60-78062 |
| Jun. 4, 1985 | [JP] | Japan | 60-122329 |
| Jun. 5, 1985 | [JP] | Japan | 60-123326 |
| Jun. 11, 1985 | [JP] | Japan | 60-127668 |
| Sep. 18, 1985 | [JP] | Japan | 60-207630 |

[51] Int. Cl.[4] ..... G03G 13/10

[52] U.S. Cl. ..... 430/119; 430/125; 118/652

[58] Field of Search ..... 430/115, 119, 125

[56] References Cited

U.S. PATENT DOCUMENTS

| | | | |
|---|---|---|---|
| 3,779,924 | 12/1973 | Chechak | 430/106 |
| 3,885,960 | 5/1975 | Anderson | 430/118 |
| 4,138,351 | 2/1979 | Gilliams | 430/115 X |

*Primary Examiner*—J. David Welsh

*Attorney, Agent, or Firm*—Cushman, Darby & Cushman

[57] ABSTRACT

Disclosed is a process of developing images formed on a photosensitive material for electrophotography which does not cause the fogging originated from a pair of squeeze rolls made of materials different from each other and which includes the steps of developing the images with a liquid developer of the positive type containing a compound having a polyoxyethylene group or at least one compound selected from the group consisting of phosphate, sulfate and sulfonate salts having a group soluble in the carrier liquid and free from polyoxyethylene group.

10 Claims, No Drawings

METHOD OF DEVELOPING ELECTRONIC PHOTOGRAPH WITH LIQUID DEVELOPER AND CLEANING EXCESS THEREOF

This is a continuation of application Ser. No. 06/849,378, filed Apr. 8, 1986, which was abandoned upon the filing hereof.

BACKGROUND OF THE INVENTION

This invention relates to a method of development with a liquid developer used in electrophotography and, more particularly, to a method of making a printing plate.

An electrophotographic offset master such as zinc oxide photosensitive paper is converted into a printing plate through the processing steps of negative charging, imagewise exposure, liquid development, and fixing. The liquid developer used in the processing is a positive charge type. The excess liquid developer remained on the developed surface of the master is removed immediately after the development by squeezing through a pair of squeeze rolls. It is naturally desirable that there be plenty of toner particles on the image areas sufficient for receiving a necessary amount of the printing ink and none on the non-image areas. The toner particles adhered to the non-image areas, which cause fogging, are generally originated from the development step. In some plate making units, however, fogging takes place frequently after the development. For instance, in a unit employing a pair of squeeze rolls different from each other in construction material, the rolls acquire static charges due to triboelectricity under conditions of low temperature and especially low humidity which prevail in winter, and there is formed a line of electric force between two rolls which induces the electrophoresis of toner particles to allow the latter to adhere to the roll.

In a particular case of a pair of squeeze rolls comprising a metal roll and an elastic roll such as rubber roll, which are arranged so that the metal roll may be brought into contact with the photosensitive surface of the master, it seems that although both rolls acquire positive charges due to the triboelectricity, yet the positive charge on the elastic roll is larger, resulting in adherence of toner particles having positive charges to the metal roll. The toner particles adhered to the metal roll and gradually accumulated thereon are transferred to the photosensitive surface of the master to cause background staining (fogging).

The toner particles are generally imparted with positive charge by charge controlling agents such as polyvalent metal salts of resin acid or fatty acid. Accordingly, it might be considered possible to overcome the above difficulty by reducing the amount of charge controlling agents, thereby to decrease the positive charge. However, the reduction in the quantity of charge controlling agent is not effective to solve the problem, but rather enhances the fogging or causes an excessive toner adhesion to the image areas which results in additional disadvantage of tailing and image distortion.

SUMMARY OF THE INVENTION

An object of this invention is to provide a method of development which prevents the fogging originated from a squeeze roll pair comprising a metal roll and an elastomer roll.

Another object of this invention is to provide a method of development which prevents the fogging originated from a squeeze roll pair comprising a metal roll and an elastomer roll, without injuring the desirable characteristics of the liquid developer.

Other objects of this invention will become apparent from the following description.

DESCRIPTION OF THE INVENTION

The objects of this invention have been achieved by a method of development wherein a photosensitive material for electrophotography is developed with a liquid developer and the excess developer is removed by means of a pair of squeeze rolls made of materials different from each other, which is characterized by using a liquid developer of the positive charge type containing a compound having a polyoxyethylene group or at least one compound selected from the group consisting of phosphate, sulfate, and sulfonate salts having a group soluble in the carrier liquid and free from polyoxyethylene group.

The invention is described in detail below.

The compounds having a polyoxyethylene group (hereinafter referred to briefly as POE) include those known as nonionic and anionic surface active agents. It is well known that nonionic or anionic surface active agents are used for the purpose of controlling the dispersibility or the charge receptive property of the liquid toner for electrophotography. The liquid developer used in the present method, however, has positive charge sufficient enough for practical use even in the absence of a compound having POE. In said liquid developer, use is made of a charge controlling agent which firmly adheres to the surface of toner particles to convert them into positive ions, thereby imparting positive charge to the toner particles.

The exact reason for the fact that a compound having POE serves to achieve the objects of this invention is yet to be elucidated. It is true that the addition of a compound having POE affects to a certain degree the positive charge receptivity of toner particles. However, the advantage gained according to this invention is not dependent on the change in charge receptivity of toner particles, because, as described later, nonionic surface active agents used for comparison failed to exhibit the advantage similar to that obtained according to this invention and, in addition, the compounds having POE include those which enhance the positive charge receptivity and those which reduce it.

Typical examples of the compounds having a POE group are as shown below. The numerals in parentheses indicate the number of oxyethylene units.

1. POE (6) sorbitan monostearate
2. POE (20) sorbitan tristearate
3. POE (20) sorbitan monostearate
4. POE (20) sorbitan monopalmitate
5. POE (20) sorbitan monolaurate
6. POE (20) sorbitan monooleate
7. POE (60) sorbitol tetrastearate
8. POE (30) sorbitol tetraoleate
9. POE (60) sorbitol tetraoleate
10. POE (5) glyceryl monostearate
11. POE (15) glyceryl monostearate
12. POE (15) glyceryl monooleate
13. POE (10) monostearate
14. POE (25) monostearate
15. POE (45) monostearate
16. POE (55) monostearate
17. POE (10) monooleate
18. POE lanolin (e.g. TW-30 of Nikko Chemicals Co.)

19. POE (10) lanolin alcohol
20. POE (40) lanolin alcohol
21. POE (20) sorbitol beeswax
22. N-di-POE (15) stearylamine
23. N-di-POE (10) oleylamine
24. POE (8) stearylpropylenediamine
25. N-di-POE (15) stearamide
26. N-di-POE (5) oleamide
27. N-di-POE (15) oleamide
28. POE (10) POP (4) cetyl ether (POP stands for polypropylene which is bound to cetyl group through ether linkage)
29. POE (20) POP (4) cetyl ether
30. POE (30) POP (6) decyl tetradecyl ether
31. POE (10) phytosterol
32. POE (30) phytosterol Of these compounds, especially preferred ones are ether compounds having a POE group Typical examples of such compounds are as shown below. The numerals in parentheses indicate the number of oxyethylene units.

Compounds represented by the formula $$R—O13\ (CH_2CH_2O)_nH \quad [A]$$

R=alkyl
POE (42) lauryl ether
POE (21) lauryl ether
POE (20) cetyl ether
POE (40) cetyl ether
POE (20) stearyl ether
POE (10) oleyl ether
POE (20) oleyl ether
POE (20) behenyl ether
POE (30) behenyl ether
POE (30) hexadecyl ether
POE (30) decyltetradecyl ether
POE (20) abietyl ether Compounds represented by the formula

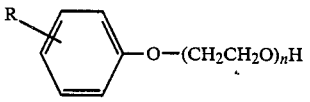
[B]

POE (5) nonylphenyl
POE (10) nonylphenyl ether
POE (20) nonylphenyl ether
POE (3) octylphenyl ether
POE (10) octylphenyl ether
POE (30) octylphenyl ether Compounds represented by the following formulas

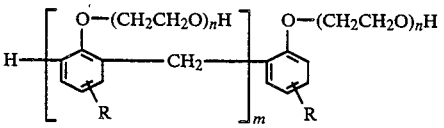
[C]

R: alkyl such as octyl and nonyl.

$$R—O—(CH_2CH_2O)_n—SO_3M \quad [D]$$

R: alkyl such as lauryl and stearyl.
M: cation such as sodium and ammonium or hydrogen.

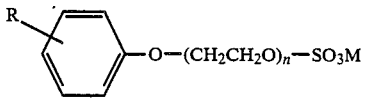
[E]

R: alkyl such as actyl and nonyl.
M: cation such as sodium and ammonium.

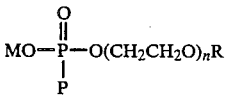
[F]

M: hydrogen or cation
R: alkyl
POE (10) lauryl ether phosphate, sodium
POE (4) lauryl ether phosphate, sodium
POE (5) cetyl ether phosphate, sodium
POE (2) lauryl ether phosphate
POE (8) oleyl ether phosphate, sodium Compounds represented by the formula

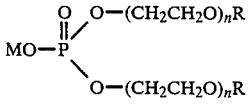
[G]

R: alkyl
Di-POE (4) nonylphenyl ether phosphate
Di-POE (n) alkyl ether phosphate
n=2, 4, 6, 8, 10 . . .

Compounds represented by the formula

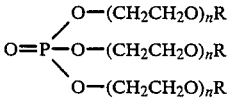
[H]

R: alkyl
Tri-POE (n) alkyl ether phosphate
n=2, 4, 6, 8, 10 . . .

Compounds represented by the formula

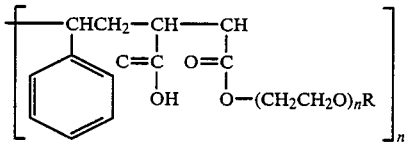
[I]

R: alkyl

Other POE-containing ether compounds include POE alkyl ether acetate and POE-hardened castor oil (POE bound with ricinoleic acid through ether linkage).

Although the amount to be used of the POE-containing compound varies depending on the type of the compound, type and amount of toner particles and the positive charge controlling agent, and other conditions, yet a standard amount is in the range of from 0.001 to 5 parts by weight for 1,000 parts by weight of the carrier liquid. The POE-containing compound is added to the carrier liquid in the form of solution in an organic solvent such as methanol, ethanol, butyl acetate, toluene, or xylene.

Another class of the compounds used in the method of this invention include phosphate salts, sulfate salts, and sulfonate salts which have no POE group but a group soluble in the carrier liquid. Examples of such compounds are calcium alkylbenzenesulfonates which were described in Japanese Pat. Application "Kokai" (Laid-open) No. 79,640/73 as negative charge controlling agents. According to the present invention, there is provided a method of development by using a liquid developer of the positive charge type containing said sulfonate salts.

Another example is a metal salt of dialkylsulfosuccinic acid described as negative charge controlling agent in Japanese Patent Application "Kokai" (Laid-open) No. 47,437/76. According to the present invention, there is provided a method of development by using a liquid developer of the positive charge type containing such a sulfosuccinate salt.

The salt compounds used in the method of the present invention include phosphate salts, sulfate salts, and sulfonate salts containing a group such as an alkyl group having 5 to 22 carbon atoms which impart solubility in the carrier liquid to the salt compound. These compounds are salts with a metal such as sodium, potassium, calcium, or aluminum; ammonium, amines, or ethanolamines. The salt compounds include those represented by the following formulas wherein R is an alkyl group and M is a salt-forming atom or molecule.

(1) $R—O—SO_3M$ (alkyl sulfate salt)

(2) $R—SO_3M$ (alkyl sulfonate salt)

(3)

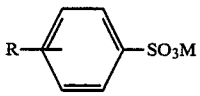

(alkylbenzenesulfonate salt)

(4)

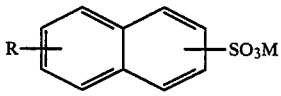

(alkylnaphthalenesulfonate salt)

(5)

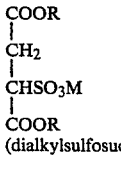

(dialkylsulfosuccinate salt)

(6)

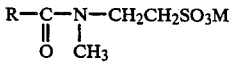

(fatty acid amidosulfonate salt)

(7)

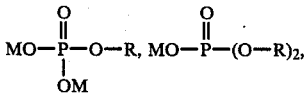

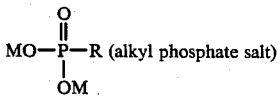

(alkyl phosphate salt)

Amount and method of addition of these nonionic surface active agents may be the same as for the above POE compounds.

The liquid developer used in the method of this invention is prepared by various known methods such as, for example, mixing together a colorant, resin, and charge controlling agent, then dispersing the mixture, by means of a dispersion mill such as "Attritor" or ball mill, in a carrier liquid such as petroleum-base aliphatic or aromatic hydrocarbons or halogenated aliphatic hydrocarbons, and diluting the resulting concentrated toner dispersion with a carrier liquid having a low dielectric constant and a high insulation resistance; or adding the concentrate containing a colorant, resin, and charge controlling agent dropwise into said carrier liquid to produce toner particles; or polymerizing a monomer in a high-insulating carrier liquid having a low dielectric constant to produce toner particles, and adding a colorant and a charge controlling agent to the resulting liquid toner.

The carrier liquids used in this invention are those having a low dielectric constant and a high electric insulation such as, for example, n-paraffin hydrocarbons, isoparaffin hydrocarbons, cycloaliphatic hydrocarbons, aromatic hydrocarbons, and halogenated aliphatic hydrocarbons. Preferred carrier liquids are isoparaffin hydrocarbons such as, for example, "Shell Sol" 71 (Shell Petroleum Co.), "Isopar" G, H, K, and L (Esso Petroleum Co.), and "IP Solvent" (Idemitsu Petroleum Co.).

Suitable toner particles include dyes and pigments, such as carbon black, coated with resins such as, for example, alkyd resins, acrylic resins, rosin, rubber, or styrene-acrylic ester copolymers; and resin particles colored with oil-soluble dyes such as Oil Black and Oil Red, basic azo dyes such as Bismarck Brown and Chrysoidine, acid azo dyes such as Wool Black, Amide Black Green, and Blue Black HF, direct dyes such as Direct Deep Black and Congo Red, anthraquinone dyes such as Sudan Violet and Acid Blue, carbonium dyes such as Auramine, Malachite Green, Crystal Violet, and Victoria Blue, rhodamine dyes such as Rhodamine B, and quinoneimine dyes such as Sofranine, Nigrosine, and Methylene Blue, as described in Japanese Patent Application "Kokai" (Laid-open) Nos. 54,029/78, 52,588/78, 123,138/78, 48,738/82, 129,450/82, 55,939/83, 83,174/84, and 212,851/84.

In the case of offset printing plates, in view of the ink receptivity and fixability, a liquid developer containing resin-base toner particles is preferred and is used jointly with a charge controlling agent to make up for insufficient charge receptivity. The positive charge controlling agent suitable for use in the present method can be any substance capable of firmly adhering to the surface of toner particles and forming micelles thereon or any substance capable of partially dissolving in the carrier liquid and forming a positive ion, thereby to establish a static charge double layer on the surface of toner particles to impart a positive charge to the particles. Examples of such substances are salts of organic acids, such as rosin acid and fatty acids, with metals such as aluminum, calcium, magnesium, cobalt, manganese, iron, zinc, and copper; and the compounds described in Japanese Patent Application "Kokai" (Laid-open) Nos. 71,943/74, 79,932/77, 123,138/78, 95,955/80, 70,557/81, and 90,643/82.

The positive charge controlling agents especially suitable for use in the method of this invention are those compounds which are represented by the formula

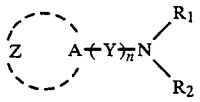

[I]

wherein A represents a carbon or nitrogen atom, Y represents a bivalent group, n is 0 or 1, $R_1$ and $R_2$ represent each a hydrogen atom or an organic group, and Z represents a group of atoms necessary for forming a nitrogen-containing ring nucleus. Examples of each compounds are as shown below.

(1)

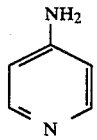

(2)

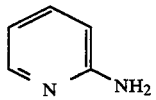

(3)

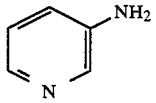

(4)

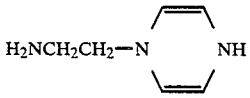

(5)

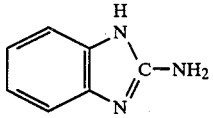

(6)

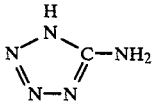

(7)

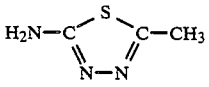

(8)

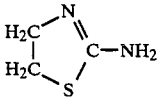

(9)

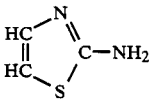

(10)

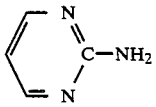

(11)

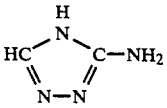

-continued (12)

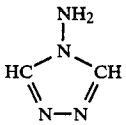

(13)

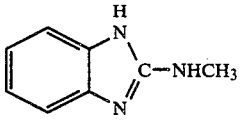

(14)

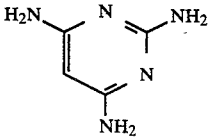

(15)

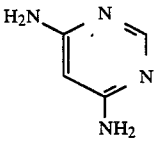

(16)

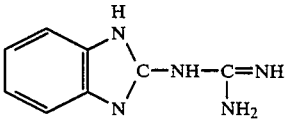

(17)

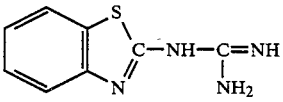

(18)

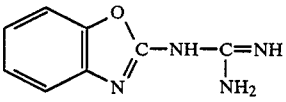

These nitrogen-containing heterocyclic compounds having an amino group behave as charge controlling agent which imparts adequate positive charge to the toner particles and the charge stability is especially excellent. One of the ways for a charge controlling agent to impart a positive charge to the toner particles is such that said agent is present in the form of salt with an acid such as carboxylic acid in the carrier liquid. The salt formation changes the amino group (9)

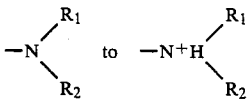

by protonation, and the acid suitable for such a salt formation is not limited to carboxylic acid. Since the compounds of the formula [I] are insoluble or difficultly soluble in the carrier liquid, they are added preferably in the form of salt with acids and as a solution in an organic solvent such as methanol, ethanol, dimethylformamide, butyl acetate, toluene, or xylene The acids used in the salt formation are preferably more soluble in the carrier liquid than the compounds of formula [I]. Such acids include aromatic acids such as benzoic acid and cinnamic acid, and saturated or unsaturated fatty acids such as propionic acid, butyric acid, valeric acid, caproic acid, capric acid, lauric acid, myristic acid, palmitic acid, stearic acid, behenic acid, cerotic acid, oleic acid, sorbic acid, linolic acid, and linolenic acid. These acids can enhance the positive charge when they are soluble to some extent in the carrier liquid. A more desirable salt-forming acid is a polymer acid soluble in the carrier liquid, which is prepared by copolymerizing an addition-polymerizable carboxylic acid, such as acrylic acid, methacrylic acid, itaconic acid, crotonic acid, maleic acid, or fumaric acid, with a monomer represented by the formula

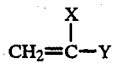

$X=H$ or $CH_3$; $Y=COOCmH_{2m+1}$ $(6 \leqq m \leqq 22)$, $CnH_{2n+1}$ $(2 \leqq n \leqq 20)$, or $OCpH_{2p+1}$ $(6 \leqq p \leqq 20)$ The polymer acid can be used without prior salt formation when it is added to the toner resin particles and the compound of formula [I ] is added to the carrier liquid to form the salt.

The charge controlling agent is used normally in an amount of 0.001 to 0.5 parts by weight for 1000 parts by weight of the carrier liquid. The optimum amount should be determined according to the type and quantity of the POE-containing compound.

The present method of development can be carried out by using a development unit disclosed in Japanese Utility Model Application "Kokai" (Laid-open) No. 126,656/81 for example.

The invention is illustrated in detail below with reference to Examples.

EXAMPLE 1

Developer A:

Into a 1-liter flask provided with a stirrer, thermometer, and nitrogen inlet, were charged 500 g of an isoparaffin-base hydrocarbon ("IP Solvent" of Idemitsu Petroleum Co.), 100 g of lauryl methacrylate, 5 g of methacrylic acid, and 1 g of benzoyl peroxide (BPO) as polymerization initiator. The mixture was allowed to polymerize by heating in a water bath at 85° C. for 5 hours to produce a polymer solution. A 100 g portion of the polymer solution and 300 g of IP Solvent were placed in a 1-liter flask provided with a stirrer, thermometer, dropping funnel, and nitrogen inlet. To the flask while being heated in a water bath at 70° C., was added dropwise from the dropping funnel over a period of 3 hours a mixture of 100 g of vinyl acetate, 10 g of N-vinylpyrrolidone, 5 g of methyl acrylate, and 1 g of azobisisobutyronitrile (AIBN) as polymerization initiator, said monomers being used to give an insoluble copolymer The mixture was heated under a nitrogen atnxosphere for further 3 hours and cooled down to room temperature The reaction product was a very stable white emulsion containing a composite resin as dispersed phase To the emulsion while being stirred, was added dropwise a solution of 5 g of Oil Black HBB in 20 g of xylene. After addition of 1 g of aluminum stearate as charge controlling agent, the emulsion was diluted 50 fold with IP Solvent to yield a liquid toner which was a positive charge type and showed good dispersion stability. The inspection of electronmicrograph revealed that the toner particles were 0.2 μm in size and uniformly distributed.

Developer B:

A toner solution was prepared in the same manner as described above, except that 1 g of aluminum salt of steberite rosin was used in place of the charge controlling agent used in developer A.

Developer C:

A toner solution was prepared in the same manner as described above, except that 1 g of laurylamine palmitate was used in place of the charge controlling agent used in developer A.

Developer D:

A toner solution was prepared in the same manner as described above, except that 1 g of half-docosanylamide of a diisobutylene-maleic acid copolymer was used in place of the charge controlling agent used in developer A.

Using the above developers A to D and the development unit (printing plate processor) disclosed in Japanese Utility Model "Kokai" (Laid-open) No. 126,656/81, 0 zinc oxide electrophotographic offset masters were successively processed under the conditions: 20° C., 50% RH. Every developer showed accumulation of the developing agent on the metal roll of a squeeze roll pair and the accumulated developing agent was transferred to the master surface, resulting in fogged non-image areas receptive to the ink.

On the other hand, 30 g of a 10% xylene solution of POE(20) sorbitan monooleate or POE(45) monostearate was added to each of the developers A to D. The resulting eight types of developers were used in the processing of offset masters. Every developer showed substantially no fogging. The developers derived from developer A and the POE-containing compounds showed the following maximum reflection densities.

| Developer | Density |
|---|---|
| Developer A | 1.54 |
| Developer A + POE(20) sorbitan monooleate | 1.57 |
| Developer A + POE(45) monostearate | 1.50 |

COMPARATIVE EXAMPLE

Each 30 g of solutions of the under-mentioned surface active agents in xylene was added to the developers A to D of Example 1. Tests were conducted on each developer as in Example 1. The fogging caused by the unintended transfer from the squeeze roll pair was not improved.

Sorbitan monolaurate
Sorbitan monostearate
Glyceryl monostearate
Glyceryl distearate
Decaglyceryl pentastearate
Propylene glycol monostearate
Stearylamine

EXAMPLE 2

Using POE-compounds 2, 9, 14, 22, 27, and 29, tests were carried out in a manner similar to that in Example 1. The results obtained were similar to those obtained in Example 1.

EXAMPLE 3

Into a 1-liter flask, were charged 100 g of stearyl methacrylate, 10 g of methoxypolyethylene glycol methacrylate

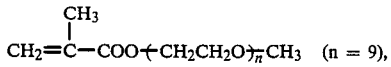

$$CH_2{=}\overset{CH_3}{\overset{|}{C}}{-}COO{+}CH_2CH_2O{\rightarrow}_n CH_3 \quad (n = 9),$$

and 1.8 g of AIBN followed by 500 g of IP Solvent. The flask was heated with stirring at 75° C. for 5 hours. A 100 g portion of the reaction mixture, 50 g of methyl methacrylate, 35 g of styrene, 10 g of hydroxyethyl methacrylate, and 1.0 g of AIBN were placed in a 1-liter flask and heated with stirring at 75° C. for 5 hours. The reaction mixture was a stable emulsion of 0.15μ in average particle size. To the stirred emulsion, was added dropwise a solution of 8 g of Oil Black HBB (Orient Chemical Co.) in 60 g of xylene. To the emulsion, were added the same charge controlling agents in the same amounts based on toner resin as in Example 1. Each of the resulting emulsions was diluted with IP Solvent to a concentration of 0.9% on dry basis to obtain developers A' to C'.

The developers A' to C' showed fogging due to unintended transfer of developing agents from the squeeze roll pair. To the developers A' to C', were added the undermentioned POE-containing compounds in the same amounts based on toner resins by weight as used in Example 1. The test similar to that in Example 1 showed no fogging due to unintended transfer of developing agents from the squeeze roll pair.

POE(20) sorbitan monolaurate
POE(15) glyceryl monooleate

EXAMPLE 4

30 g of 10% xylene solutions of POE(20) cetyl ether or POE(30) behenyl ether were added to the developers A to D of Example 1, respectively, to prepare 8 types of developers. The resulting developers were used in the processing of offset masters. Every developer showed entirely no fogging. The developers derived from developer A and the POE-containing compounds showed the following maximum reflection densities.

| Developer | Density |
|---|---|
| Developer D | 1.52 |
| Developer D + POE(20) cetyl ether | 1.47 |
| Developer D + POE(30) behenyl ether | 1.61 |

EXAMPLE 5

In a manner similar to that in Example 1, one of the following POE-containing ether compounds was added to developer B or D of Example 1 and tested.

POE(5) nonylphenyl ether
POE(10) nonylphenyl ether
POE(20) nonylphenyl ether
POE(10) octylphenyl ether
POE(8) oleyl ether phosphate (sodium salt)
POE(10) lauryl ether phosphate (sodium salt)
Di-POE(4) nonylphenyl ether phosphate
Tri-POE(10) alkyl ether phosphate (Nikkol TDP-10, tradename, Nikko Chemicals Co.)
POE alkyl ether phosphate (Prisurf A208B, tradename, Daiichi Kogyo Co.)
POE nonylphenyl ether sulfate (ammonium salt) (Hithenol N-07, tradename, Daiichi Kogyo Co.)
A compound of formula [I] (Nikkol SMD-10, tradename, Nikko Chemicals Co.)

No fogging due to the squeeze roll pair was observed.

EXAMPLE 6

To the developers A' to D' of Example 3, were respectively added each of the undermentioned compounds in the same amount by weight based on toner resin as used in Example 1. Tests were performed as in Example 1. No fogging due to the squeeze roll pair was observed.

POE(20) stearyl ether
POE(21) lauryl ether

EXAMPLE 7

To each of the developers A to D of Example 1, was added a xylene solution containing 2 g of sodium dioctylsulfosuccinate to prepare developers A' to D'. These developers were used in the processing of the offset master as in Example 1. No fogging due to the squeeze roll pair was observed in every case.

The developers B and B' showed maximum reflection densities of 1.48 and 1.60, respectively.

The steberite rosin aluminum salt content of the developer B' was increased to 1.5 g. The maximum reflection density was 1.51 and entirely no fogging was observed.

EXAMPLE 8

To the developer A of Example 1, was added 2 g of calcium or aluminum di-(2-ethylhexyl)sulfosuccinate. The processing test performed as in Example 1 showed no fogging due to unintended toner transfer from the squeeze roll pair.

EXAMPLE 9

To the developer A of Example 1, was added 4 g of sodium lauryl phosphate, sodium oleyl phosphate, or dodecyl phosphate amine salt. Test was performed as in Example 1. Toner fogging due to the squeeze roll pair was not observed.

EXAMPLE 10

The procedure of preparation of developer A in Example 1 was repeated except that as the charge controlling agent, a xylene solution (30 g) prepared by heating 15 g of a 20% xylene solution of lauryl methacrylate-methacrylic acid copolymer and 1 g of the amino group-containing heterocyclic compound 6 and as a transfer fog preventing agent, 30 g of a xylene solution containing 5 g of sodium salt of POE(10) lauryl ether phosphate were added to the emulsion and was diluted 50-fold with IP Solvent to prepare a liquid toner. This liquid toner was a stable dispersion of a toner having positive charge and an average particle size of 0.2 μm, the size distribution being uniform, as determined by electromcrography. The test was performed as in Example 1 and no transfer fogging was observed.

To examine the charge stability, the maximum reflection density of the image obtained by the liquid toner was determined after storage at 40° C. for 3, 7, and 14 days. The results obtained were as shown in the following table.

| Immediately after preparation | Storage (day) | | |
|---|---|---|---|
| | 3 | 7 | 14 |
| 1.52 | 1.50 | 1.51 | 1.51 |

EXAMPLE 11

A liquid toner was prepared in the same manner as in Example 10, except that heterocyclic compound 5 was used in place of the compound 6. The liquid toner was found excellent in charge stability and transfer fog prevention; no defect such as image distortion or tailing was found.

What is claimed is:

1. A process of developing images on a photosensitive material for electrophotography which includes the steps of developing the images with a liquid developer of the positive charge type containing a carrier liquid, a positive charge toner particle, a charge controlling agent which imparts positive charge to the toner particle and a compound having a polyoxyethylene group and removing an excess developer by means of a pair of squeeze rolls made of materials different from each other.

2. A process according to claim 1 wherein said surfactant compound is a compound having a polyoxyethylene group selected from the following:

1. POE(6) sorbitan monostearate
2. POE(20) sorbitan tristearate
3. POE(20) sorbitan monostearate
4. POE(20) sorbitan monostearate
5. POE(20) sorbitan monolaurate
6. POE(20) sorbitan monooleate
7. POE(60) sorbitol tetrastearate
8. POE(30) sorbitol tetraoleate
9. POE(60) sorbitol tetraoleate
10. POE(5) glyceryl monostearate
11. POE(15) glyceryl monostearate
12. POE(15) glyceryl monooleate
13. POE(10) monostearate
14. POE(25) monostearate
15. POE(45) monostearate
16. POE(55) monostearate
17. POE(10) monooleate
18. POE lanolin
19. POE(10) lanolin alcohol
20. POE(40) lanolin alcohol
21. POE(20) sorbitol beeswax
22. N-di-POE(15) stearylamine
23. N-di-POE(10) oleylamine
24. POE(8) stearylpropylenediamine
25. N-di-POE(15) stearamide
26. N-di-POE(5) oleamide
27. N-di-POE(15) oleamide
28. POE(10) POP(4) cetyl ether (POP stands for polypropylene which is bound to cetyl group through ether linkage)
29. POE(20) POP(4) cetyl ether
30. POE(30) POP(6) decyl tetradecyl ether
31. POE(10) phytosterol
32. POE(30) phytosterol 3. A process according to claim 1 wherein said surfactant compound is a compound having a polyoxyethylene group selected from the following ether compounds having polyoxyethylene group:

(1) Compounds represented by the formula $$R—O—(CH_2CH_2O)_nH \quad [A]$$

R=alkyl (2) Compounds represented by the formula

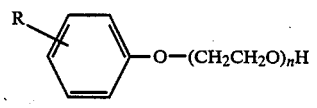

[B]

R=alkyl (3) Compounds represented by the following formulas

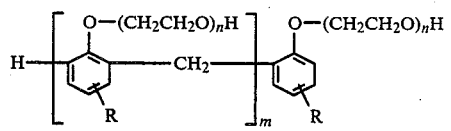

[C]

R: alkyl (4) Compounds represented by the formula $$R—O—(CH_2CH_2O)_n—SO_3M \quad [D]$$

R: alkyl

M: cation or hydrogen (5) Compounds represented by the formula

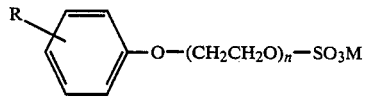

[E]

R: alkyl

M: cation (6) Compounds represented by the formula

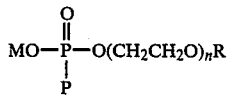

[F]

M: hydrogen or cation

R: alkyl (7) Compounds represented by the formula

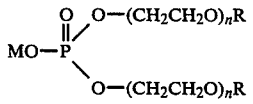

[G]

R: alkyl (8) Compounds represented by the formula

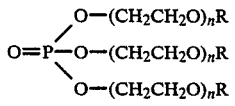

[H]

R: alkyl (9) Compounds represented by the formula

[I]

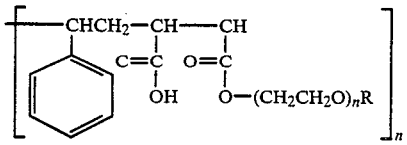

R: alkyl

4. A process according to claim 1 wherein the amount of said compound having polyoxyethylene group is 0.001to 5 parts by weight per 1,000 parts by weight of the carrier liquid.

5. A process according to claim 1 wherein the carrier liquid is selected from the group consisting of n-paraffin hydrocarbons, isoparaffin hydrocarbons, cycloaliphatic hydrocarbons, aromatic hydrocarbons and halogenated aliphatic hydrocarbons.

6. A process according to claim 1 wherein the charge controlling agent is a compound represented by the following general formula [I]:

[I]

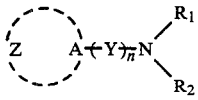

wherein A represents a carbon or nitrogen atom, Y represents a bivalent group, n is 0 or 1, $R_1$ and $R_2$ represent each a hydrogen atom or an organic group, and Z represents a group of atoms necessary for forming a nitrogen-containing ring nucleus.

7. A process according to claim 6 wherein the compound is in the form of a salt with an acid.

8. A process according to claim 7 wherein the acid is a carboxylic acid or a polymer acid.

9. A process according to claim 8 wherein the polymer acid is one prepared by copolymerizing a carboxylic acid with a monomer represented by the formula:

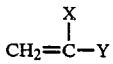

wherein X=H or $CH_3$; Y=$COOCmH_{2m+1}$ ($6 \leqq m \leqq 22$), $CnH_{2n+1}$ ($2 \leqq n \leqq 20$), or $OCpH_{2p+1}$ ($6 \leqq p \leqq 20$)

10. A process according to claim 1 wherein the amount of the charge controlling agent is 0.001 to 0.5 parts by weight per 1,000 parts by weight of the carrier liquid.

* * * * *